US006768700B2

(12) United States Patent
Veneruso et al.

(10) Patent No.: US 6,768,700 B2
(45) Date of Patent: Jul. 27, 2004

(54) METHOD AND APPARATUS FOR COMMUNICATIONS IN A WELLBORE

(75) Inventors: Anthony F. Veneruso, Missouri City, TX (US); Robert J. Coon, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 463 days.

(21) Appl. No.: 09/790,829

(22) Filed: Feb. 22, 2001

(65) Prior Publication Data

US 2002/0114216 A1 Aug. 22, 2002

(51) Int. Cl.[7] ..... H04H 9/00
(52) U.S. Cl. ..... 367/81; 340/853.2; 340/853.3
(58) Field of Search ..... 340/853.2, 853.3; 367/81

(56) References Cited

U.S. PATENT DOCUMENTS

| | | | | |
|---|---|---|---|---|
| 3,209,323 A | | 9/1965 | Grossman, Jr. | |
| 3,697,940 A | * | 10/1972 | Berka | 340/855.3 |
| 4,544,035 A | | 10/1985 | Voss | |
| 4,806,928 A | | 2/1989 | Veneruso | |
| 4,901,069 A | | 2/1990 | Veneruso | |
| 4,971,160 A | | 11/1990 | Upchurch | |
| 5,008,664 A | | 4/1991 | More et al. | |
| 5,050,675 A | | 9/1991 | Upchurch | |
| 5,052,941 A | | 10/1991 | Hernandez-Marti et al. | |
| 5,278,550 A | | 1/1994 | Rhein-Knudsen et al. | |
| 5,455,573 A | | 10/1995 | Delatorre | |
| 5,521,592 A | | 5/1996 | Veneruso | |
| 5,535,828 A | | 7/1996 | der Kinderen et al. | |
| 5,547,029 A | * | 8/1996 | Rubbo et al. | 166/375 |
| 5,941,307 A | * | 8/1999 | Tubel | 166/313 |
| 5,971,072 A | | 10/1999 | Huber et al. | |
| 6,046,685 A | * | 4/2000 | Tubel | 340/853.2 |
| 6,216,784 B1 | * | 4/2001 | Harrell | 166/250.15 |
| 6,360,820 B1 | * | 3/2002 | Laborde et al. | 166/66 |
| 6,470,996 B1 | * | 10/2002 | Kyle et al. | 181/103 |

FOREIGN PATENT DOCUMENTS

GB 2 372 521 A 8/2002

* cited by examiner

*Primary Examiner*—Timothy Edwards
(74) *Attorney, Agent, or Firm*—Trop, Pruner & Hu P.C.; Jeffrey Griffin; Brigitte Jeffery Echols

(57) ABSTRACT

A downhole string includes a system having an actuator module that is responsive to electrical power and signals communicated down a cable, such as a permanent downhole cable (PDC). In addition, a backup mechanism, such as an inductive coupler mechanism or another type of wireless apparatus, can be used as a backup to restore power and communications with the downhole system. For example, if the cable fails for some reason, power and signals can still be communicated with the inductive coupler mechanism or other wireless mechanism to control operation of the system or to receive signals from the system.

44 Claims, 6 Drawing Sheets

METHOD AND APPARATUS FOR COMMUNICATIONS IN A WELLBORE

TECHNICAL FIELD

The invention relates to methods and apparatus for communications in a wellbore.

BACKGROUND

To produce hydrocarbons from a subterranean formation, a wellbore is drilled into the earth. Following drilling, the wellbore is completed by installing completion equipment, including casing, liner, production tubing, packers, valves, and so forth. One or more zones in the well are perforated to enable communication between a target formation and the wellbore. Once perforated, wellbore fluids are allowed to enter the wellbore and flow up the production tubing to the well surface.

In many wells, multiple zones are operated for production of well fluids. To ensure a proper flow profile, valves that can be set at various choke positions are installed in the wellbore to control the fluid flow rate from each zone. For example, differences in pressures of the different zones may cause flow from the higher pressure zone to the lower pressure zone, which reduces fluid flow to the well surface. Valves may be set to control flow rates so that proper fluid flow can occur to the well surface. Also, if production of water or other undesirable fluids occur, some of the valves may be shut off completely to prevent flow from the one or more water-producing zones into the wellbore.

With improvements in technology, wellbores can now be equipped with so called smart or intelligent completion systems, which typically have sensors, gauges, and other electronic devices in the wellbore. The sensors and gauges are used to monitor various well characteristics, including temperature, pressure, flow rate, and formation characteristics. Additionally, downhole components such as valves may be controlled remotely from the well surface or at another remote location. Thus, if any problems occur during production of the well, valves and/or other downhole components may be adjusted to remedy the problem.

To communicate with such downhole devices, a typical arrangement uses a permanent downhole cable (PDC) that is run from the well surface to one or more downhole components. The PDC is used to deliver power to the downhole components as well as to deliver control signals to such components. Additionally, sensors and gauges are able to communicate measurements up the PDC to a surface controller.

Due to the relatively harsh conditions in the wellbore as well as various intervention operations that are performed in the wellbore, there is some likelihood that a PDC can be damaged during its many months or years of operation so that communication of power and signals to downhole components is no longer possible. When that occurs, the downhole components are rendered inoperable.

A need thus exists for a method and apparatus to ensure or increase the likelihood of continued operation of well components even if a communication mechanism such as a downhole cable is damaged.

SUMMARY

In general, in accordance with one embodiment, a method of communications in a wellbore comprises determining if a first communications mechanism for communicating with a downhole device is operational, and running a backup communications mechanism into the wellbore if the first communications mechanism is not operational. The method further comprises communicating with the downhole device using the backup communications mechanism.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "below" and "above"; and other like terms indicating relative positions above or below a given point or element are used in this description to more clearly describe some embodiments of the invention. However, when applied to equipment and methods for use in wells that are deviated or horizontal, or when applied to equipment and methods that when arranged in a well are in a deviated or horizontal orientation, such terms may refer to a left to right, right to left, or other relationship as appropriate.

Figure 1A:
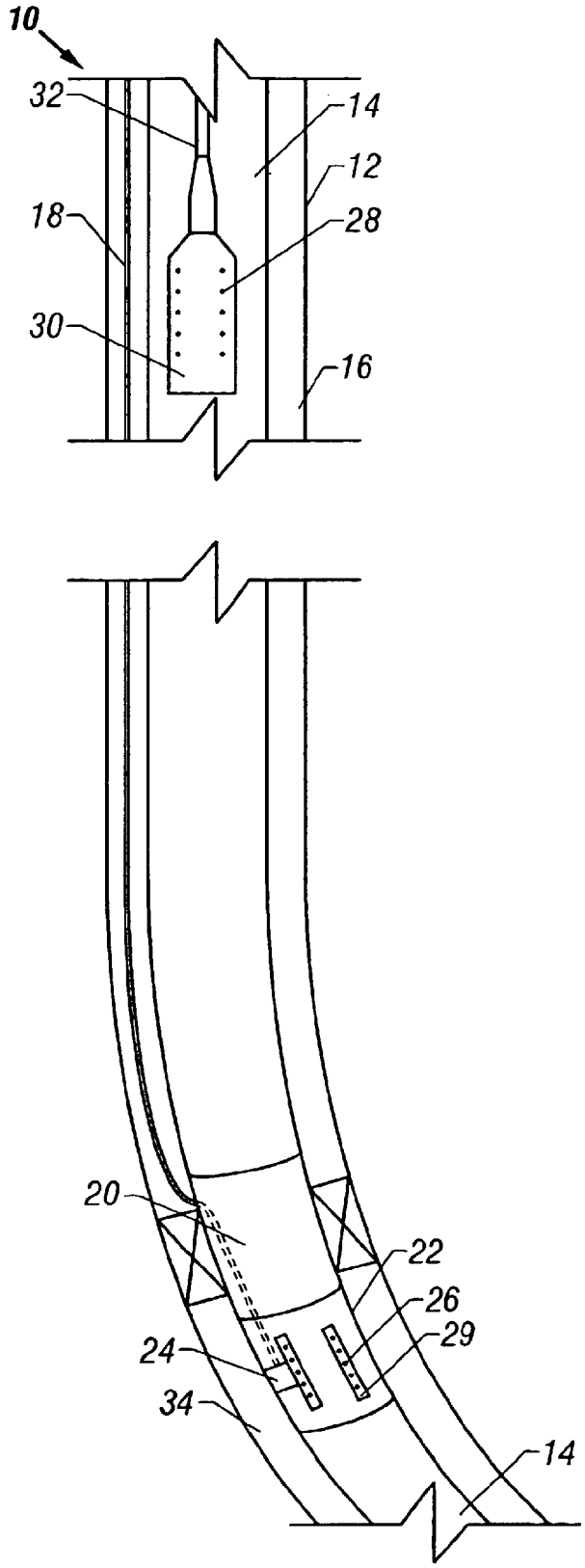
FIG. 1A illustrates an alternative embodiment of a completion string.

Referring to FIG. 1, a completion string in a wellbore 10 includes casing 12, a production tubing 14, and a packer 20 to isolate an annulus region 16 between the production tubing 14 and the casing 12. A flow control system 22 is coupled to the production tubing 14 to control fluid flow from a lower annulus region 34 into the bore of the production tubing 14. The flow control system 22 includes an actuator module 24 to control flow rate through the flow control system 22. For example, a valve in the flow control system 22 can be set in an open position, a closed position, or at one or more intermediate positions. The ability to choke the flow from the lower annulus region 34 into the production tubing 14 is particularly advantageous in situations where there are multiple zones in the wellbore 10. In such an instance, due to pressure differences between the zones, the flow rates from the different zones may have to be set differently to enable and to optimize fluid flow into the wellbore and to the surface.

In one embodiment, the actuator module 24 in the flow control system 22 is electrically operated. Power and signals are communicated to the actuator module 24 by a cable 18 that extends in the wellbore 10 from the surface to the actuator module 24. In one example, the cable 18 is a permanent downhole cable (PDC) that is installed with the completion string.

In accordance with some embodiments of the invention, a backup or redundant mechanism for delivering power and signals to the actuator module 24 is provided. In the illustrated embodiment of FIG. 1, the backup mechanism includes an inductive coupler mechanism (120 in FIG. 2) having a first portion 30 that is delivered on a carrier line 32 (e.g., a wireline, coiled tubing, or other carrier mechanism having an electrical or optical communications channel). The first portion 30 is referred to as the male portion, and includes a first coil element 28 connected by electrical cable 27 to a surface controller.

The male portion 30 is adapted to fit into a second portion 29 of the inductive coupler mechanism 120. The second portion 29 is part of the flow control system 22 and includes a female coil element 26, which when vertically aligned with the male coil element 28 enables coupling of electrical energy and signals between the coil elements 26 and 28. An electrical current generated in the coil element 28 is inductively coupled to the coil element 26. Examples of inductive coupler systems include those described in U.S. Pat. Nos. 4,806,928; 4,901,069; 5,052,941; 5,278,550; 5,971,072; 5,050,675; and 4,971,160.

In another embodiment, the first portion 30 of the inductive coupler mechanism 120 includes a female coil element while the second portion 29 includes a male coil element. In yet another embodiment, the first and second inductive coupler portions 30 and 29 have other coil arrangements. The inductive coupler mechanism 120 is one example of a wireless apparatus that can be used as the backup communications mechanism. More generally, in other embodiments, other types of wireless apparatus can be employed, such as those using electromagnetic signals, pressure pulse signals, acoustical signals, optical signals, and other signals capable of being communicated between two elements without electrical wiring in at least a portion of the communications mechanism.

Figure 1B:
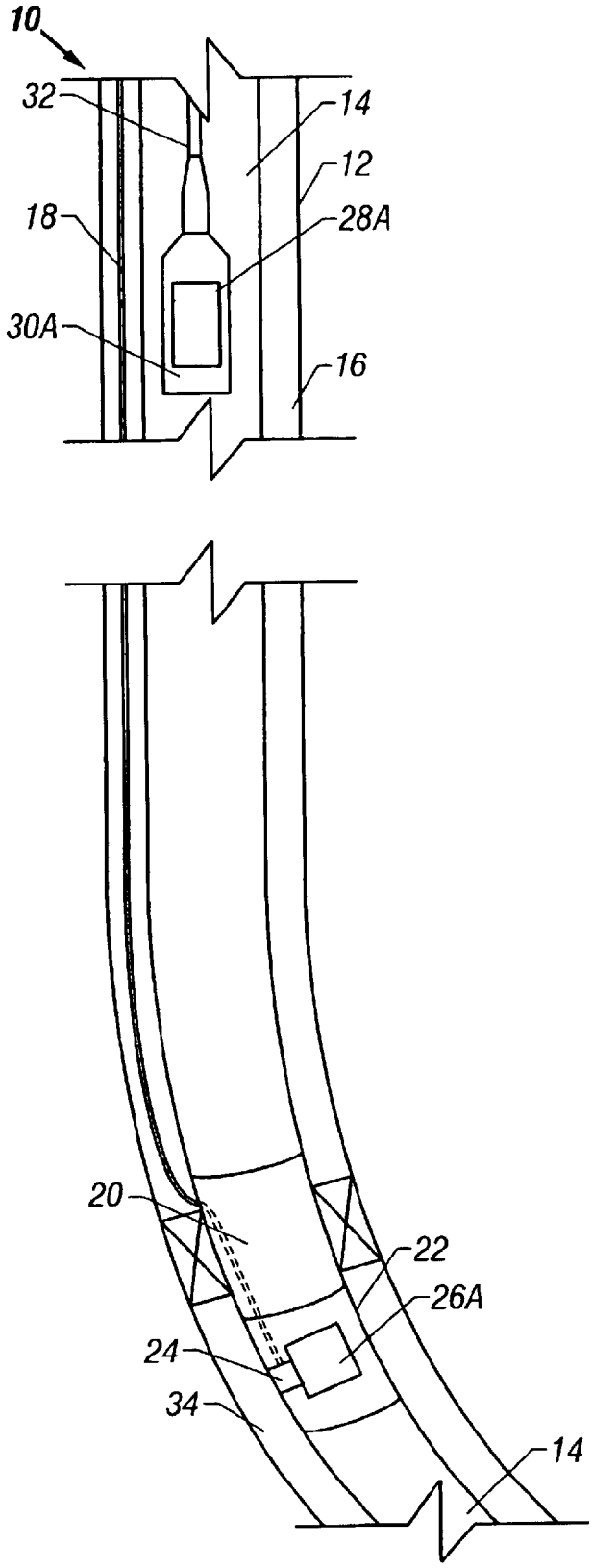
FIG. 1B illustrates an embodiment of a completion string positioned in a wellbore and having a valve assembly, a cable extending in the wellbore to the valve assembly, and an inductive coupler mechanism making up a backup or redundant electrical communications mechanism.

As shown in FIG. 1B, the backup mechanism includes a carrier device 30A that contains a first wireless portion 28A. The backup mechanism also includes a second wireless portion 26A that is positioned downhole. The first and second wireless portions 28A and 26A communicate wireless signals, pressure pulse signals, acoustical signals, optical signals, etc. In these alternative embodiments, a downhole power source (e.g., a battery) may be provided in the flow control system 22. In yet other embodiments, instead of carrying the first wireless portion 28A on a carrier line 32, the first wireless portion 28A may be statically positioned at a predetermined downhole location in the wellbore or at the surface.

Figure 2:
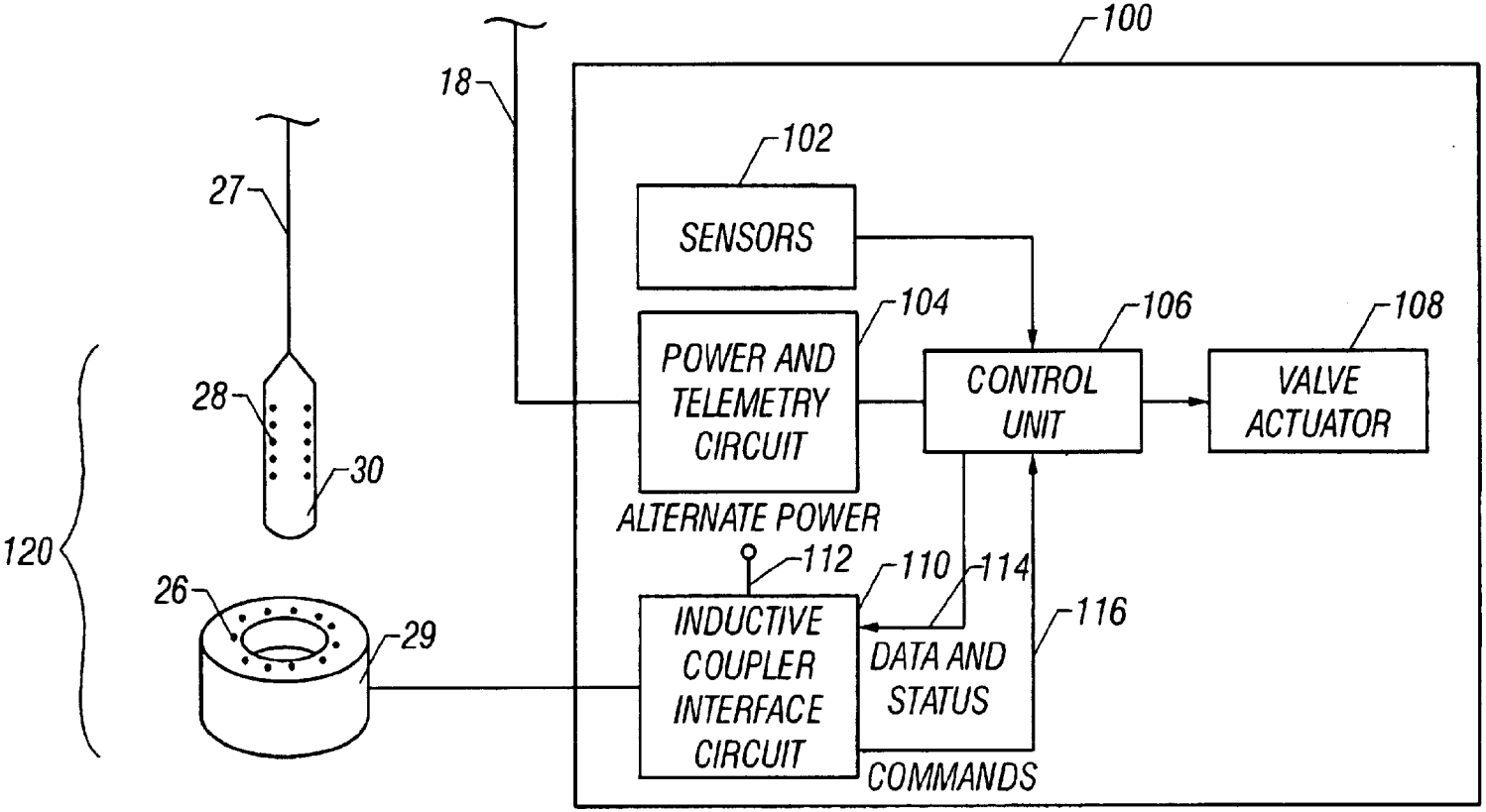
FIG. 2 illustrates the electrical components of the valve assembly of FIG. 1 and the backup or redundant electrical communications mechanism that can power the valve assembly.

Referring to FIG. 2, electrical components 100 that are part of the actuator module 24 (FIG. 1) are illustrated. The components include one or more sensors 102, such as pressure and temperature sensors, sensors to measure fluid flow rates, sensors to detect valve positions, and other sensors or gauges. The outputs of the sensors 102 are fed to a control unit 106, which may be a microprocessor, microcontroller, or other electronic device. Power and signals communicated down the cable 18 are received by a power and telemetry circuit 104, which communicates the power and signals to the control unit 106. In response to command signals, the control unit 106 controls the activation or deactivation of a valve actuator 108.

If the cable 18 fails for any reason, then the backup power and signal communications mechanism in the form of the inductive coupler mechanism 120 can be used. The male inductive coupler portion 30 that includes the first coil element 28 is run into the wellbore, with the male portion 30 received by the female inductive coupler portion 29 with the second coil element 26. Electrical currents generated in the male coil element 28 are inductively coupled to the female coil element 26, with the current provided to an inductive coupler interface circuit 110. Based on the current generated in the female coil element 26, the interface circuit 110 supplies alternate power 112 used to power the various components, including sensors 102, the control unit 106, and the valve actuator 108. Also, the interface circuit 110 is capable of generating commands in response to signals received through the inductive coupler mechanism 120. The commands include an override command to indicate to the control unit 106 that it is to switch from the power and telemetry circuit 104 to the inductive coupler interface circuit 110 for communications. An example of a power and signaling technique is described in U.S. Pat. No. 4,901,069.

Further, data collected by the sensors 102 can be communicated by the control unit 106 as data and status information 114 to the interface circuit 110, which generates a current in the female coil element 26 to induce a reverse current in the male coil element 28 so that data signals are communicated up the cable 27 to a surface controller.

Figure 3:
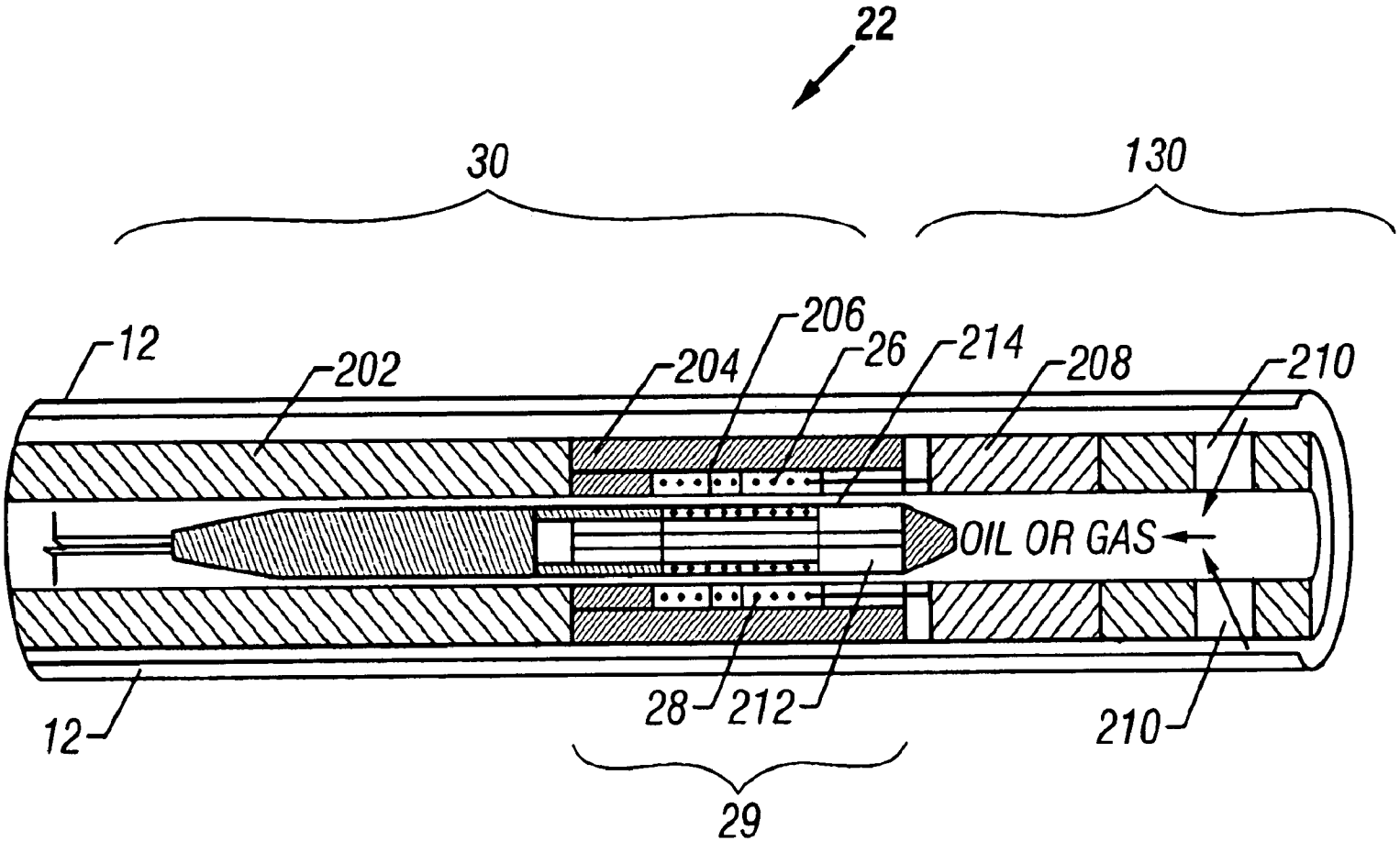
FIG. 3 illustrates the inductive coupler mechanism for operating the valve assembly of FIG. 1.

Referring to FIG. 3, a portion of the flow control system 22 is illustrated with the male inductive coupler portion 30 positioned inside the flow control system 22. As shown, the male coil element 28 is aligned with the female coil element 26 to enable inductive coupling of electrical energy generated in one of the coil elements. Electrical signals are used to control the valve actuator 108 (shown in FIG. 2) to control the position of a valve 208. In the illustrated embodiment, the valve 208 is a sleeve valve that controls flow through one or more ports 210. The sleeve valve 208 is actuateable up or down by the valve actuator 108 to open or close the ports 210, or to provide one or more intermediate choke positions.

The female coil element 26 is contained in a sleeve or housing 204, which in one embodiment is formed of a metal. The sleeve or housing 204 defines a chamber in which the female coil element 26 can be positioned. In addition, a protective layer 206 surrounds the inner diameter of the female coil inductive coupler portion 29 to cover the female coil element 26. The layer 206 is sealingly attached (e.g., such as by welding or by some other attachment mechanism) to the sleeve or housing 204 to provide a sealed chamber in which the female coil element is located.

In some embodiments, the protective layer 206 is formed of a material that is impervious or substantially impermeable to wellbore fluids; that is, the protective layer seals against and prevents penetration of corrosive gases and liquids, such as salt water, hydrogen sulfide, and carbon dioxide, into the female coil element 26 throughout a long period of use (e.g., months or years). Example materials that can be used to form the protective layer 206 include metal (e.g., nickel, titanium, chrome, stainless steel, a nichrome alloy made with 79% nickel and 21% chromium) or non-metal (e.g., glass, non-porous ceramic). In addition to being impervious, another desirable characteristic of the protective layer 206 is that it is non-corrosive so that the female inductive coupler portion 29 may be positioned downhole for a relatively long period of time while withstanding the relatively harsh wellbore environment. Another desirable characteristic of the protective layer 206 is that it exhibits relatively low electrical conductivity, by virtue of the above material selection and its relatively small thickness, so that the efficiency in inductive coupling between the female coil element 26 and the male coil element 28 can be enhanced as compared to inductive coupling through an electrically conductive layer.

Yet another characteristic of the protective layer 206 is that it is non-magnetic. Thus, in one embodiment, the protective layer 206 is formed of a material that is (1) non-magnetic, (2) non-corrosive, and (3) substantially impermeable or impermeable to corrosive gases and liquids, and (4) that has relatively high electrical resistivity (low conductivity).

Figure 4:
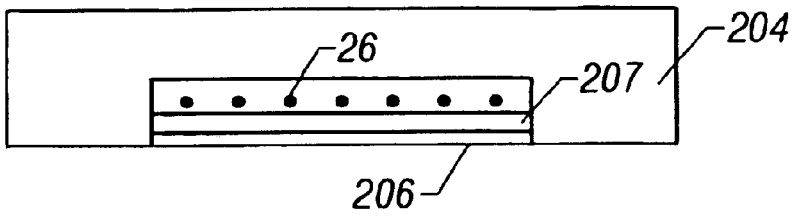
FIG. 4 illustrates an embodiment of a protective shield mechanism for the female inductive coupler portion of FIG. 3.

In one embodiment, as shown in FIG. 4, for added strength, the protective layer 206 is applied onto a strengthening substrate 207, such as a substrate formed of a polymer, e.g., polyetheretherketone (PEEK) or PEEK reinforced with a filler, such as fiber glass or carbon fibers. The protective layer 206 is provided on the outside (exposed to wellbore fluids) and the substrate 207 is on the inside. Thus, generally a protective shield mechanism can be formed of (1) a single protective layer, (2) a multilayered assembly having a protective layer and a substrate, or (3) another arrangement.

Referring again to FIG. 3, in the male inductive coupler portion 30, the male coil element 28 is carried by a member 212 that has a groove to receive the male coil element 28. In addition, a protective layer 214 is wrapped around the outside of the male coil element 28 to protect it from the wellbore environment. Because the male inductive coupler portion 30 is not kept downhole for long periods of time, the protective layer 214 may be formed of any type of insulating material, such as plastic, polymer, and the like, which does not absorb substantial amounts of electrical energy generated in response to current flowing in the male coil element 28.

Figure 5:
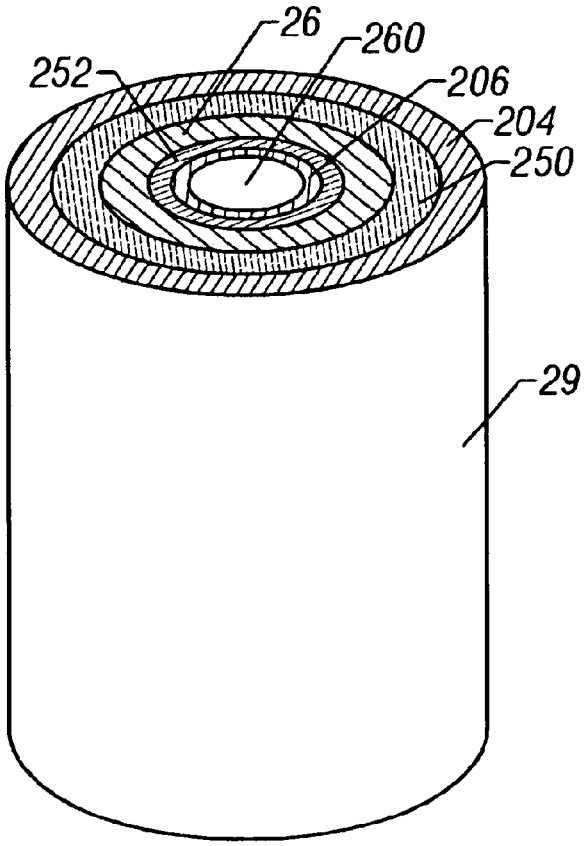
FIG. 5 illustrates the layers of the female portion of the inductive coupler mechanism of FIG. 1, in accordance with an embodiment.

Referring to FIG. 5, the various layers that make up the female inductive coupler portion 29 are illustrated. The outermost layer is the sleeve 204, which is formed of a metal. Next, an insulating layer 250 is provided between the outer sleeve 204 and the female coil element 26. Further, an insulating layer 252 is provided between the female coil element 26 and the protective layer 206, which can be a metal layer or a non-metal layer, as discussed above. The insulating layer 252 may also serve as a layer that provides structural strength (similar to layer 207 in FIG. 4). If a separate strengthening layer is employed, then it is placed between the outer diameter of the protective layer 206 and the inner diameter of the insulating layer 252. The male inductive coupler portion 30 is adapted to be inserted into a bore 260 of the female inductive coupler portion 29.

Figure 6:
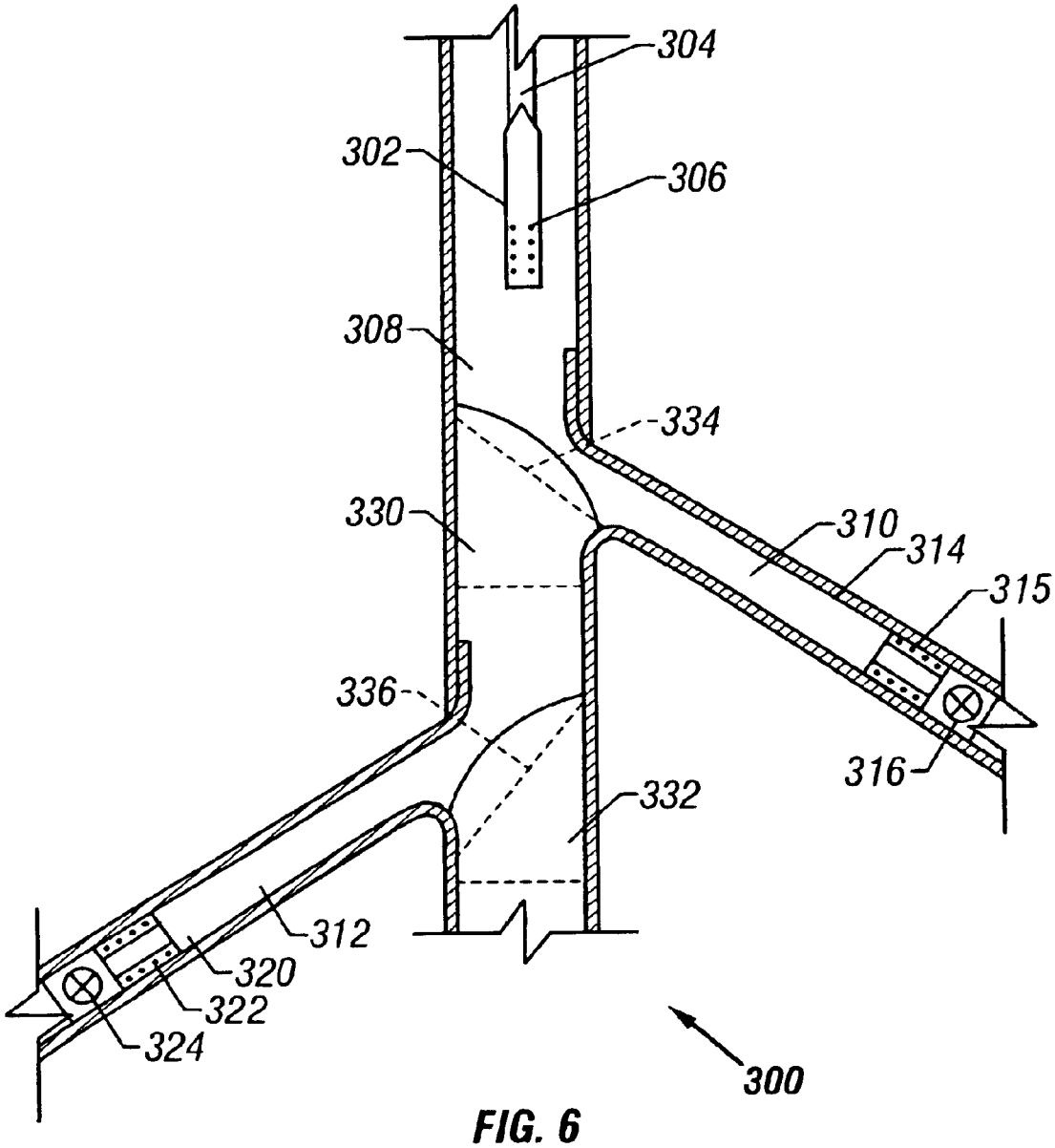
FIG. 6 illustrates a multilateral well having electrical components in the lateral branches that are capable of receiving power and communicating using the inductive coupler mechanism of FIG. 1.

Referring to FIG. 6, in addition for use in single-bore wells, such as vertical, deviated, or wells with a horizontal portion, the inductive coupler mechanism 120 discussed may also be designed for use in a multilateral well, such as the multilateral well 300 illustrated in FIG. 6. A male inductive coupler portion 302 is carried by a coiled tubing or pipe 304 into the main wellbore 308. The male inductive coupler portion 302 carries a male coil element 306. In accordance with some embodiments of the invention, the male inductive coupler portion 302 can be inserted into one of plural lateral branches 310 or 312 that extend from the main wellbore 308.

As shown by the dashed profiles, anchors 330 and 332 with respective diverting surfaces 334 and 336 (e.g., whipstocks) may be set in the main wellbore 308 prior to running the inductive coupler portion 302 into the well to direct the inductive coupler 302 into the desired one of the lateral branches 310 and 312. The anchors or whipstocks 330 and 332 are retrievable. Alternatively, instead of using a whipstock, a kick-over tool that carries the male inductive coupler portion 302 can be employed. The kick-over tool in one embodiment may engage a downhole profile, which causes the kick-over tool to deflect the male inductive coupler portion 302 towards the lateral branch. Thus, generally, a downhole element to selectively deflect a device towards the lateral branch refers to either a whipstock, a kick-over tool, or any other deflecting device.

In the first lateral branch 310, a female inductive coupler portion 314 is electrically coupled (by wired or wireless connection) to electrical device 316. A wireless connection includes an electromagnetic signal connection, an inductive coupler connection, an acoustical connection, an optical connection, or any other connection in which direct electrical contact is not required. Examples of the electrical device 316 include sensor, or actuatable devices (e.g., valves). When the male inductive coupler portion 302 is aligned within the female inductive coupler portion 314, an electrical current generated in the male coil element 306 causes a corresponding current to be generated in the female coil element 315. Electrical energy can also be received from the lateral branch device 316, such as electrical signals from a sensor.

Similarly, the male inductive coupler portion 302 can be selectively run into the second lateral branch 312 and positioned in a second female inductive coupler portion having a female coil element 322. The female inductive coupler portion 320 is electrically coupled to the device 324 to perform electrical tasks.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method of communications in a wellbore, comprising:

determining if a first communications mechanism for communicating with a downhole device is operational;

running a backup communications mechanism into the wellbore in response to determining that the first communications mechanism is not operational; and communicating with the downhole device using the backup communications mechanism.

2. The method of claim 1, wherein running the backup communications mechanism into the wellbore is performed after determining that the first communications mechanism is not operational.

3. The method of claim 1, wherein determining if the first communications mechanism is operational comprises determining if an electrical cable is operational.

4. The method of claim 3, wherein running the backup communications mechanism comprises running at least a first portion of an inductive coupler mechanism into the wellbore.

5. The method of claim 1, wherein providing the secondary, wireless communications link comprise providing a first portion of an inductive coupler coupled to the well device.

6. The method of claim 5, further comprising running a second portion of an inductive coupler device into the well into functional alignment with the first portion.

7. The method of claim 1, wherein running the backup communications mechanism comprises running a wireless apparatus.

8. The method of claim 7 wherein running the wireless apparatus comprises running an inductive coupler element.

9. The method of claim 7 wherein determining if the first communications mechanism is operational comprises determining if an electrical cable is operational.

10. The method of claim 7, further comprising positioning a first element of the wireless apparatus downhole, wherein running the wireless apparatus comprises running a second element of the wireless apparatus proximal the first element.

11. The method of claim 10, wherein positioning the first element comprises positioning a first inductive coupler element and running the second element comprises running a second inductive coupler element.

12. A method of communications in a well, comprising:

providing a primary communications link from a well surface to a well device; and providing a secondary, wireless communications link from the well surface to the well device.

13. The method of claim 12, wherein providing the secondary, wireless communications link comprise providing a link for carrying one of electromagnetic signals, pressure pulse signals, acoustical signals, and optical signals.

14. The method of claim 9, wherein inserting the secondary, wireless communications link comprises running an inductive coupler portion into the well after determining that the primary communications link is not operational.

15. An apparatus for use in a wellbore, comprising:

a first communications link adapted to extend from a well surface to a downhole device; and a redundant link adapted to extend from the well surface to the downhole device, the redundant link comprising a wireless apparatus.

16. The apparatus of claim 15, wherein the first communications link comprises an electrical line.

17. The apparatus of claim 13, wherein the redundant link comprises an inductive coupler portion adapted to be run into the wellbore after detection of the first communications link being in-operational.

18. The apparatus of claim 15, wherein the wireless apparatus comprises an inductive coupler mechanism.

19. The apparatus of claim 18, wherein the inductive coupler mechanism comprises a female coil electrically coupled to the downhole device and a male coil for running into the wellbore.

20. The apparatus of claim 18, wherein the inductive coupler mechanism comprises a first part positioned in the wellbore and a second part adapted to be lowered into and removed from the wellbore.

21. The apparatus of claim 20, further comprising a downhole component defining a chamber, the first part being enclosed in the chamber.

22. The apparatus of claim 21, wherein the downhole component comprises a housing and a protective layer attached to the housing.

23. The apparatus of claim 22, wherein the protective layer is formed of a material that exhibits relatively low electrical conductivity and that is impervious to corrosive gases and liquids.

24. The apparatus of claim 23, wherein the protective layer material is selected from the group consisting of nickel, titanium, chrome, stainless steel, a nichrome alloy, glass, and ceramic.

25. The apparatus of claim 23, wherein the protective layer material is selected from the group consisting of nickel, titanium, chrome, stainless steel, and a nichrome alloy.

26. The apparatus of claim 23, wherein the protective layer material is selected from the group consisting of glass and ceramic.

27. The apparatus of claim 23, wherein the protective layer is formed of a non-magnetic material.

28. The apparatus of claim 23, wherein the protective layer is formed of a non-corrosive material.

29. The apparatus of claim 23, wherein the downhole component further comprises a substrate, the protective layer formed on the substrate.

30. The apparatus of claim 29, wherein the substrate is formed of polymer.

31. The apparatus of claim 29, wherein the substrate is formed of polyetheretherketone.

32. The apparatus of claim 23, wherein the protective layer covers the chamber to prevent entry of corrosive gases and liquids.

33. The apparatus of claim 32, wherein the protective layer is sealingly attached to the housing to cover the chamber.

34. A communication system for use in a well, comprising:

a downhole device in the well;

a first communication link connected to the downhole device;

a redundant link connected to the downhole device, the redundant link comprising a first portion of a wireless device;

a second portion of the redundant link adapted for selective placement in the well for selective communication with the first portion.

35. The system of claim 34, wherein the first communication link comprises an electrical conductor adapted to extend from a well surface to the downhole device.

36. The system of claim 34, wherein the redundant link comprises an inductive coupler.

37. A method of operating a multilateral well having a main bore and a lateral branch, comprising:

lowering a wireless apparatus into the main bore;

engaging a downhole element to cause deflection of the wireless apparatus toward the lateral branch; and running the wireless apparatus into the lateral branch to electrically couple the wireless apparatus with a downhole device in the lateral branch.

38. The method of claim 37, wherein lowering the wireless apparatus comprises lowering a first portion of an inductive coupler.

39. Them method of claim 38, further comprising:

providing a second portion of the inductive coupler in the lateral branch; and positioning the first portion proximal the second portion for functional engagement of the first and second portions.

40. The method of claim 37, wherein engaging the downhole element comprises engaging a deflecting device.

41. A system for use in a well having a lateral branch, comprising:

a wireless apparatus having a first portion positioned in the lateral branch and a second portion adapted to be run in the well; and a downhole element adapted to deflect the second portion toward the lateral branch to enable running the second portion into the lateral branch for functional engagement with the first portion.

42. The system of claim 41, wherein the wireless apparatus comprises an inductive coupler.

43. The system of claim 41, wherein the downhole element comprises a deflecting tool.

44. The system of claim 41, wherein the downhole element comprises an anchor with a diverting surface.

* * * * *